US007246711B1

(12) United States Patent
Metcalf

(10) Patent No.: US 7,246,711 B1
(45) Date of Patent: Jul. 24, 2007

(54) ADJUSTABLE SHELVING UNIT

(75) Inventor: Derek Metcalf, Burr Ridge, IL (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 244 days.

(21) Appl. No.: 10/807,365

(22) Filed: Mar. 23, 2004

Related U.S. Application Data

(63) Continuation-in-part of application No. 10/699,396, filed on Oct. 30, 2003, and a continuation-in-part of application No. 10/643,352, filed on Aug. 19, 2003.

(51) Int. Cl.
*A47F 5/00* (2006.01)

(52) U.S. Cl. ..... 211/175; 211/88.02; 211/187; 211/106.01; 211/90.03

(58) Field of Classification Search ..... 211/175, 211/90.03, 106, 153, 134, 133.5, 106.01, 211/90.01, 90.02, 88.01, 88.02, 187, 193, 211/190, 207, 208, 87.01, 181.1, 126.9, 133.2, 211/133.3, 195
See application file for complete search history.

(56) References Cited

U.S. PATENT DOCUMENTS

| | | | | |
|---|---|---|---|---|
| 573,835 | A | 12/1896 | Taylor | |
| 1,428,730 | A | 9/1922 | Weston | |
| 1,829,009 | A | 10/1931 | Madsen | |
| 2,648,442 | A | 8/1953 | Lowmaster | |
| 3,174,627 | A | 3/1965 | Marschak | |
| 3,182,945 | A | 5/1965 | Sedo | |
| 3,248,079 | A | 4/1966 | Kennedy | |
| 3,280,989 | A | 10/1966 | Melvin et al. | |
| 3,501,020 | A | 3/1970 | Krikorian | |
| 3,572,626 | A | 3/1971 | Bertschi | |
| 3,701,325 | A | 10/1972 | Fenwick | |
| 3,760,744 | A | 9/1973 | Cruckshank | |
| 3,795,379 | A | 3/1974 | Gray | |
| 3,915,097 | A | 10/1975 | Young, Jr. | |
| 3,993,002 | A | 11/1976 | Stroh | |
| 4,065,088 | A | 12/1977 | Shell | |
| 4,155,312 | A | 5/1979 | Thorkildson | |
| 4,248,352 | A | 2/1981 | White | |
| 4,250,815 | A | 2/1981 | Swanson | |
| 4,267,931 | A * | 5/1981 | Belotta | 211/153 |
| 4,307,671 | A | 12/1981 | Albano | |

(Continued)

FOREIGN PATENT DOCUMENTS

| | | |
|---|---|---|
| EP | 0 442 398 A1 | 8/1991 |

(Continued)

*Primary Examiner*—Jennifer E. Novosad
(74) *Attorney, Agent, or Firm*—Kilpatrick Stockton LLP

(57) ABSTRACT

An adjustable shelving unit that may be adjusted by increasing or decreasing the width or depth of the unit and may be adjusted to be in either a horizontal orientation or a forward sloping orientation. The adjustable shelving unit may include a central shelf unit and at least one extension shelf unit. The extension shelf unit may be oriented in a sliding manner with respect to the central shelf unit to permit the adjustment of the width or depth of the shelf by extending or retracting the extension shelf unit with respect to the central shelf unit. Attachment members extending from the central shelf unit allow the shelf to be mounted in either a horizontal or a forward sloping orientation.

12 Claims, 18 Drawing Sheets

U.S. PATENT DOCUMENTS

| | | | | |
|---|---|---|---|---|
| 4,378,925 | A | | 4/1983 | Griffin |
| 4,492,169 | A | | 1/1985 | Ware et al. |
| 4,500,146 | A | | 2/1985 | Peterson |
| 4,553,523 | A | | 11/1985 | Stohrer |
| 4,583,648 | A | | 4/1986 | Buffington et al. |
| 4,730,738 | A | | 3/1988 | Bartus et al. |
| 5,133,463 | A | * | 7/1992 | Merl ..... 211/190 |
| 5,199,579 | A | | 4/1993 | VanDuyne |
| 5,205,421 | A | | 4/1993 | Bustos |
| 5,449,076 | A | | 9/1995 | Van Moord |
| 5,450,971 | A | | 9/1995 | Boron et al. |
| 5,460,345 | A | | 10/1995 | Trevaaskis |
| 5,547,088 | A | | 8/1996 | Belokin et al. |
| 5,641,083 | A | | 6/1997 | Metcalf |
| 5,645,182 | A | * | 7/1997 | Miller et al. ..... 211/134 |
| 5,769,247 | A | | 6/1998 | Merl |
| 5,816,419 | A | | 10/1998 | Lamson |
| 6,021,908 | A | * | 2/2000 | Mathews ..... 211/90.02 |
| 6,070,841 | A | | 6/2000 | Robinson |
| 6,109,462 | A | | 8/2000 | Emalfrb et al. |
| 6,142,321 | A | | 11/2000 | West |
| 6,189,527 | B1 | | 2/2001 | Walsh et al. |
| 6,332,548 | B1 | | 12/2001 | West et al. |
| 6,341,704 | B1 | | 1/2002 | Michel |
| 6,357,609 | B1 | | 3/2002 | Van Noord et al. |
| 6,641,098 | B1 | | 11/2003 | Proffitt |
| 6,666,344 | B1 | | 12/2003 | Schneider |
| 6,726,035 | B2 | | 4/2004 | Zadak |
| 2002/0027115 | A1 | | 3/2002 | Gay et al. |
| 2005/0039641 | A1 | | 2/2005 | Metcalf |
| 2005/0092701 | A1 | | 5/2005 | Metcalf |

FOREIGN PATENT DOCUMENTS

| | | |
|---|---|---|
| FR | 2 548 529 | 11/1985 |
| WO | WO 90/02500 | 3/1990 |
| WO | WO 2005/041726 | 5/2005 |

* cited by examiner

ADJUSTABLE SHELVING UNIT

This application is a continuation-in-part of U.S. application Ser. No. 10/699,396, filed Oct. 30, 2003 and entitled "Adjustable Cantilevered Shelf" and also a continuation-in-part of U.S. application Ser. No. 10/643,352, filed Aug. 19, 2003 and entitled "Adjustable Shelving System", both of which are herein incorporated in their entireties by this reference.

RELATIVE FIELD

Embodiments of the present invention relate to adjustable shelving units for displaying products at retail establishments and, more particularly, to shelving units adjustable in width and/or depth as well as between a horizontal display position and a forward sloping display position.

BACKGROUND

Retailers may desire to use shelving units adaptable into a variety of configurations for displaying product.

The floor plans of convenience stores and other retail establishments may vary widely from location to location. Consequently, the space available for a particular product display will also vary widely. In such circumstances, it may be desirable to provide a product display or other type of shelving system that can be adapted quickly, easily, and/or inexpensively to fit the available space. Shelving systems including shelves with adjustable widths and/or depths may be used as product displays that are quickly, easily, and/or inexpensively tailored to fit the unique location where they will be used.

Adjustable shelving systems may also be useful when it becomes necessary to rearrange shelving in a particular location in response to changing needs, desires, or available space. For instance, convenience store operators may wish to rearrange product displays from time to time. Such rearrangement may be needed or desired in response to changing inventory, the installation of new equipment, roll-out of a new product, or other changes affecting the amount of space available for a particular display. By using an adjustable shelving system, store operators may simply adjust the width and/or depth of the adjustable shelves to maximize the shelving area available for displaying product while avoiding the extra time and expense required to reconfigure a non-adjustable system, add additional product to the display, or purchase or obtain a new product display.

Previous adjustable shelves, such as the ones disclosed in U.S. Pat. Nos. 6,332,548 and 6,142,321 both to West and both entitled 'Adjustable Shelving Apparatus,' may be formed from two halves, slidably joined together by a number of interlocking channel and groove structures. The channel and groove structures permit the shelf halves to slide relative to one another such that the widths of the shelves may be increased or decreased as desired. These previous shelf structures are limited in several ways, however, because the shelf structures cannot be adjusted without also modifying or reconfiguring accompanying structure supporting the shelf structures. Because both halves of the shelves move during adjustment, adjustment of the shelves may not be accomplished without disconnecting the shelves from the accompanying support structure or modifying the shelf or the support structure. Moreover, because both halves of the shelves slide relative to each other, adjustment of the shelves may not be done without disturbing product displayed on the shelf. Also problematically, previous adjustable shelves do not provide structures for the placement of advertisements, pricing information, product identifiers or other information on the shelf that does not have to be removed or repositioned during or after adjustment of the shelf width.

Cantilevered display shelves are also a popular and convenient way to display merchandise in a retail store environment. Typically, a vertical set of supports allows the shelves to be selectively positioned in a variety of heights and spacings.

Retailers may prefer to display different types of products in different orientations. Some products, for example, appear more enticing and are better displayed on a forward sloping shelf so that a perspective view of the product is available to the customer. Other products may preferably be displayed on a flat horizontal shelf due to varying marketing strategies or logistical requirements, for example due to product packaging configuration. Therefore, having an adjustable shelf would allow a retailer to accommodate both display styles with a single shelving unit. An adjustable shelf unit would also permit retailers to use the shelf unit in different configurations at different times to best suit the product being displayed.

Many existing adjustable display shelves involve complex or intricate structures to allow the adjustment of the display shelf, including numerous parts. Such designs make the adjustable shelves more difficult to produce and use. For example, special tooling may be required to manufacture the adjustable shelf, and if the manufacturer desires to change the slope angle of the shelf, the tooling may need to be readjusted. These tooling and design considerations add to the expense of such adjustable shelving units.

Existing adjustable shelf units may be difficult to use. A retailer desiring to switch a display shelf from a horizontal position to a forward sloping position may have to make laborious adjustments in order to do so. This causes increased labor costs for the retailer who must allot employee hours to make the appropriate adjustments. Alternatively, the retailer may simply forego the advantage the adjustable shelf attempts to provide in order to avoid making the adjustments.

SUMMARY

Various embodiments of the present invention include an adjustable shelving system including at least one adjustable shelf that includes a non-moving central portion such that the shelf may be adjusted without removing the shelf from accompanying support structure or modifying the shelf or the support structure. In some embodiments, adjustment of the shelf may be accomplished without disturbing product or other items located on some portions of the shelf. Additionally, in some embodiments, the shelf may include structures for the placement of advertisements, pricing information, product identifiers or other information on the shelf that do not have to be removed or modified during or after adjustment of the shelf width and/or depth.

In various embodiments of the present invention, the shelf's dimensions may be adjusted by sliding one or more extension shelf units with respect to a central shelf unit. The extension shelf units may be slidably connected to the central shelf unit such that the dimensions of the shelf may be adjusted by sliding the extension shelf units into or out of the central shelf unit. The central shelf unit may be secured to a support structure, such as a wire stand. Consequently, only the extension shelf units, not the central shelf unit, move relative to the support structure during adjustment.

Because the central shelf unit does not move relative to the support structure, adjustment of the shelf dimensions does not require removing the shelf from the support structure. Additionally, because the central shelf unit does not move relative to the support structure during adjustment, product located on the central shelf unit, as well as any product identifiers, advertisements or other material located on the central shelf unit, may be undisturbed during shelf adjustment.

Certain embodiments of the present invention provide an adjustable shelving unit for horizontal or forward sloping displays. Each shelf is preferably rectangular. Mounting rails are located on each side of the shelf. The mounting rails comprise a top rail and a bottom rail. An upper mounting pin extends from the rear portion of the top rail and a lower mounting pin extends from the rear portion of the bottom rail. The top rail is preferably slightly longer than the bottom rail, causing the upper mounting pin and the lower mounting pin to be slightly offset.

According to certain embodiments of the present invention, a support frame comprises a base and two vertical members connected at the top by a horizontal member. The vertical members each have a front receiving surface containing a plurality of equally spaced apart openings. The shelves can be attached to the support frame causing the shelf to be either horizontal or forwardly sloping. In order for the shelves to be horizontal, the upper mounting pins of a shelf are first placed in first openings of the vertical members. The lower mounting pins are then placed flush against the front receiving surface of the vertical members. The offset of the upper and lower mounting pins causes the shelf to remain in a horizontal orientation when mounted to the support frame in this manner. If it is desired for the shelf to be forward sloping, the upper mounting members are again placed in first openings and the lower mounting pins are placed in second openings located below the first openings. Again, due to the offset of the upper and lower mounting pins, the shelf is sloped forward when mounted in this manner.

Certain embodiments of the present invention allow retailers using cantilevered display shelves to quickly and easily adjust individual shelves in order to best display a particular product. By selectively positioning the lower mounting pins either inside an opening or flush against the surface of the vertical member, a retailer can easily adjust the orientation of the shelf to achieve the desired display effect. The design is easy to use, has minimal parts needing adjustment, and provides retailers with great flexibility when displaying product.

Adjustable shelving units, according to embodiments of the present invention, may be both adjustable in width or depth and adjustable to horizontal or forward sloping orientations.

DETAILED DESCRIPTION

Figure 1:
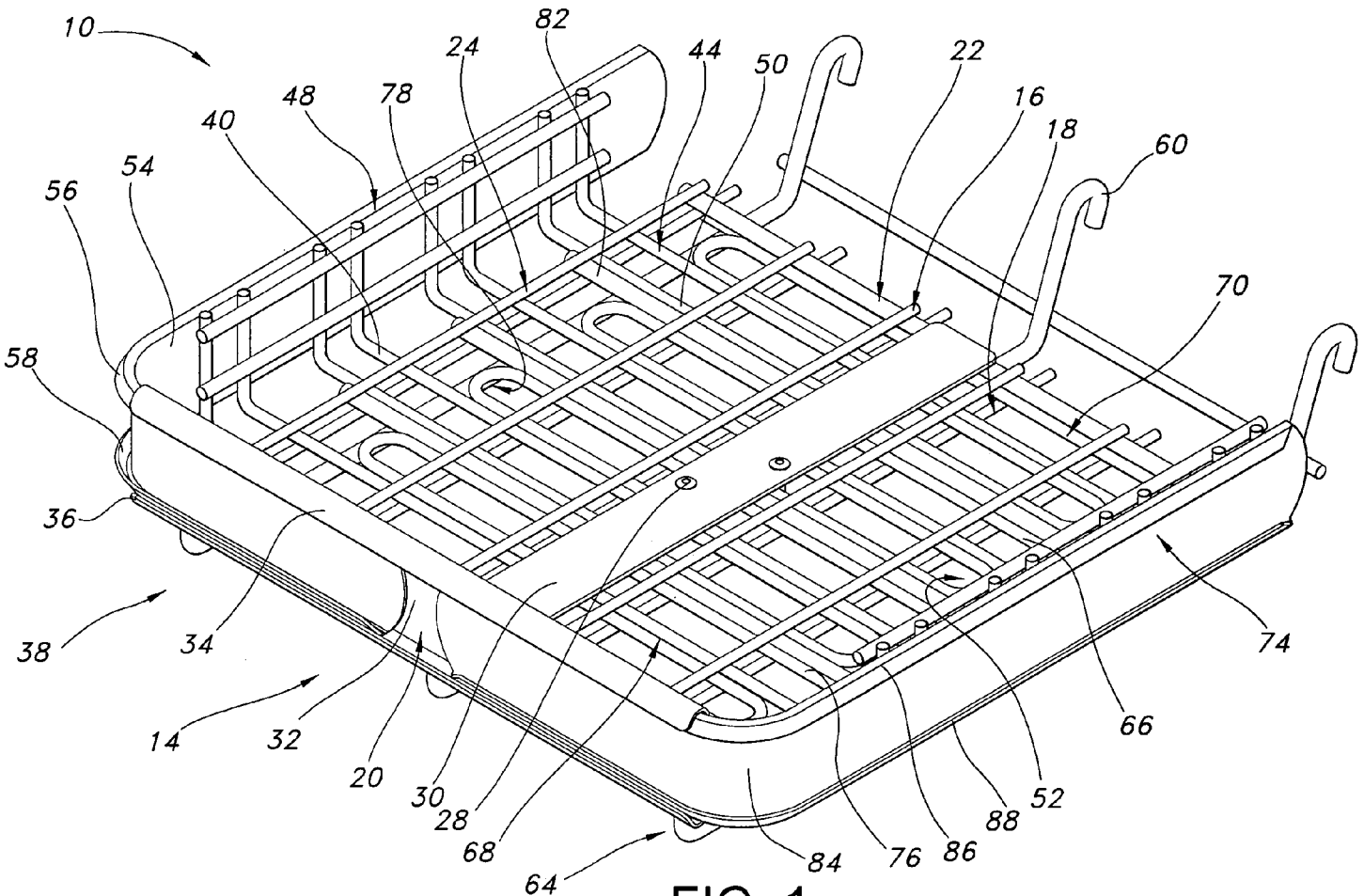
FIG. 1 shows an adjustable shelving unit in a retracted orientation according to certain embodiments of the present invention in perspective view.

FIG. 1 shows an adjustable shelf assembly 10 according to certain embodiments of the present invention. The adjustable shelf assembly 10 includes a first extension shelf unit 38 and a second extension shelf unit 64. However, according to other embodiments of the invention, an adjustable shelf assembly may include only one extension shelf unit or multiple extension shelf units. As shown in FIG. 1, first and second extension shelf units 38 and 64 are slidably secured to a central shelf unit 14. The central shelf unit 14 has a top surface 16, a bottom surface 18, a front edge 20, a rear edge 22, a first side edge 24 (shown in FIG. 2) and a second side edge 26. Top surface 16 and bottom surface 18 may be formed from any desired material. As shown in FIG. 1, the top and bottom surfaces of central shelf unit 16 and 18 in connection with rails 82 form a wire grid. As shown in FIG. 1, portions of the first and second extension shelf units 38 and 64 are located between the top and bottom surfaces of central shelf unit 16 and 18. In some embodiments, the central shelf unit does not have a bottom surface. In those embodiments, portions of the one or more extension shelf units are preferably located underneath the top surface of the central shelf unit.

Figure 2:
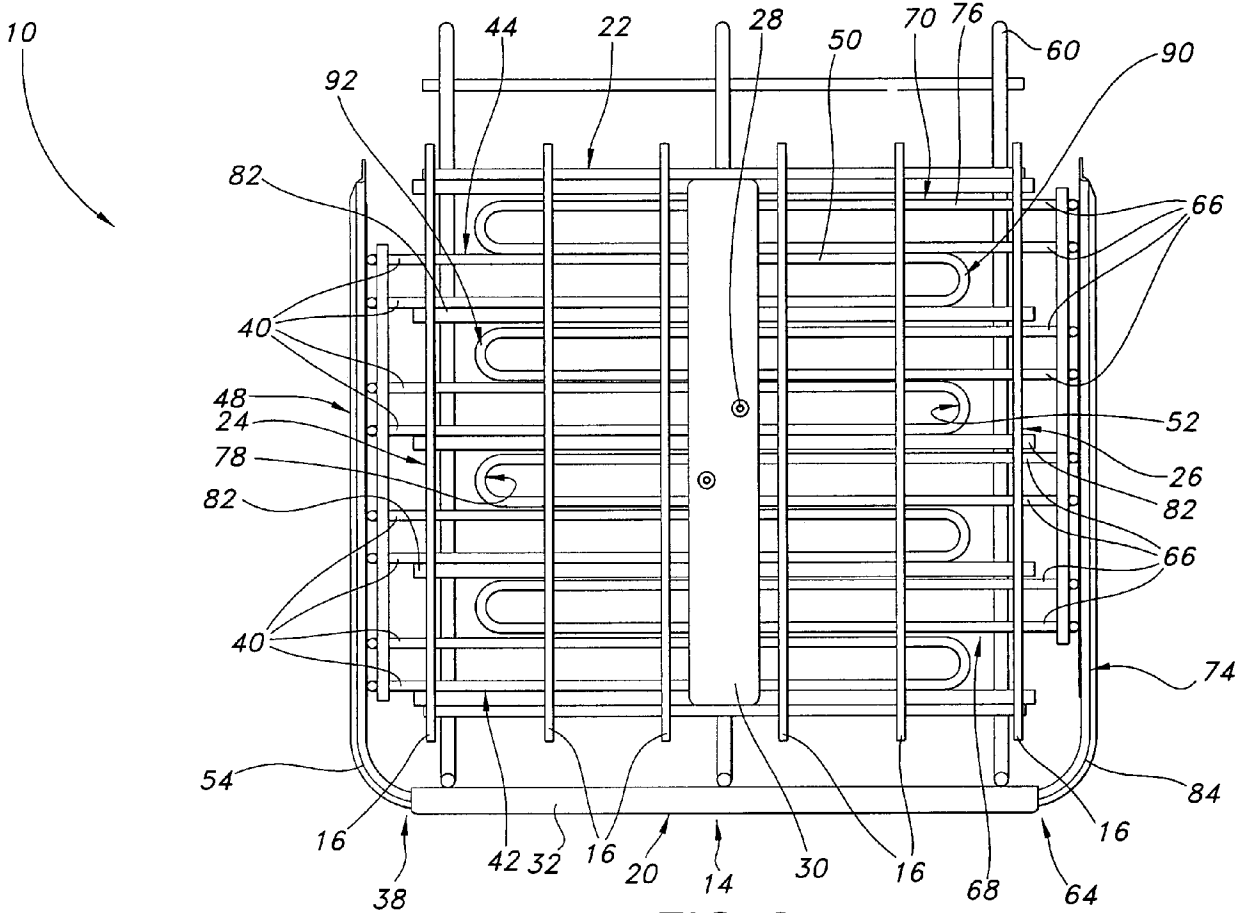
FIG. 2 shows a top view of the adjustable shelving unit of FIG. 1.

As shown in FIG. 2, first extension shelf unit 38 has a support surface 40, a front edge 42 (shown in FIG. 7), a rear edge 44, a distal side 48 and a proximate side 90. The distal side of the first extension shelf unit 48 is located distal to the central shelf unit 14 relative to the proximate side 90.

Support surface 40 may be formed from any desired material. In the embodiment shown in FIG. 2, support surface 40 is formed from bent wire.

As shown in FIG. 2, second extension shelf unit 64 has a support surface 66, a front edge 68 (shown in FIG. 7), a rear edge 70, a distal side 74 and a proximate side 92. The distal side of the second extension shelf unit 74 is located distal to the central shelf unit 14 relative to the proximate side 92. Support surface 66 may be formed from any desired material. In the embodiment shown in FIG. 2, support surface 66 is formed from bent wire.

Figure 7:
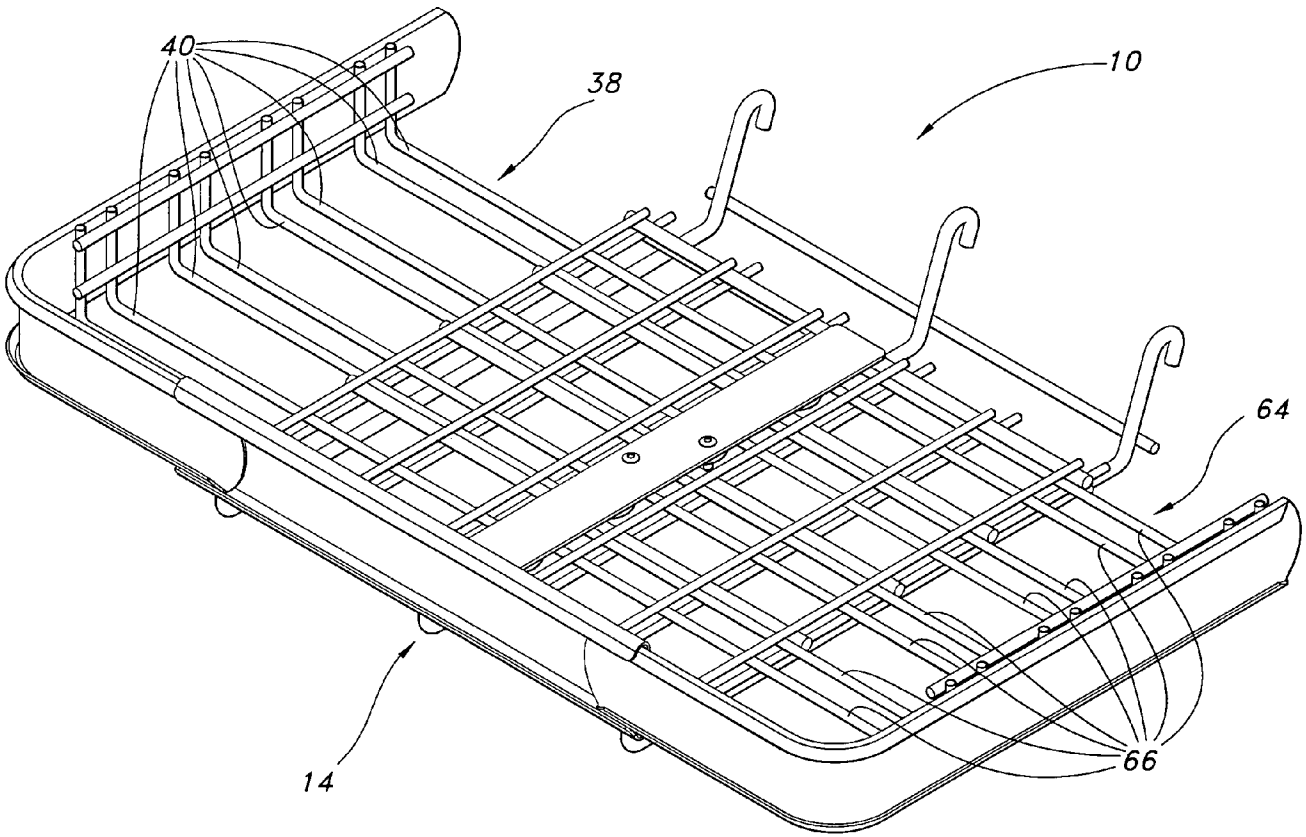
FIG. 7 shows a perspective view of the adjustable shelving unit of FIG. 1 in an extended orientation.
Figure 8:
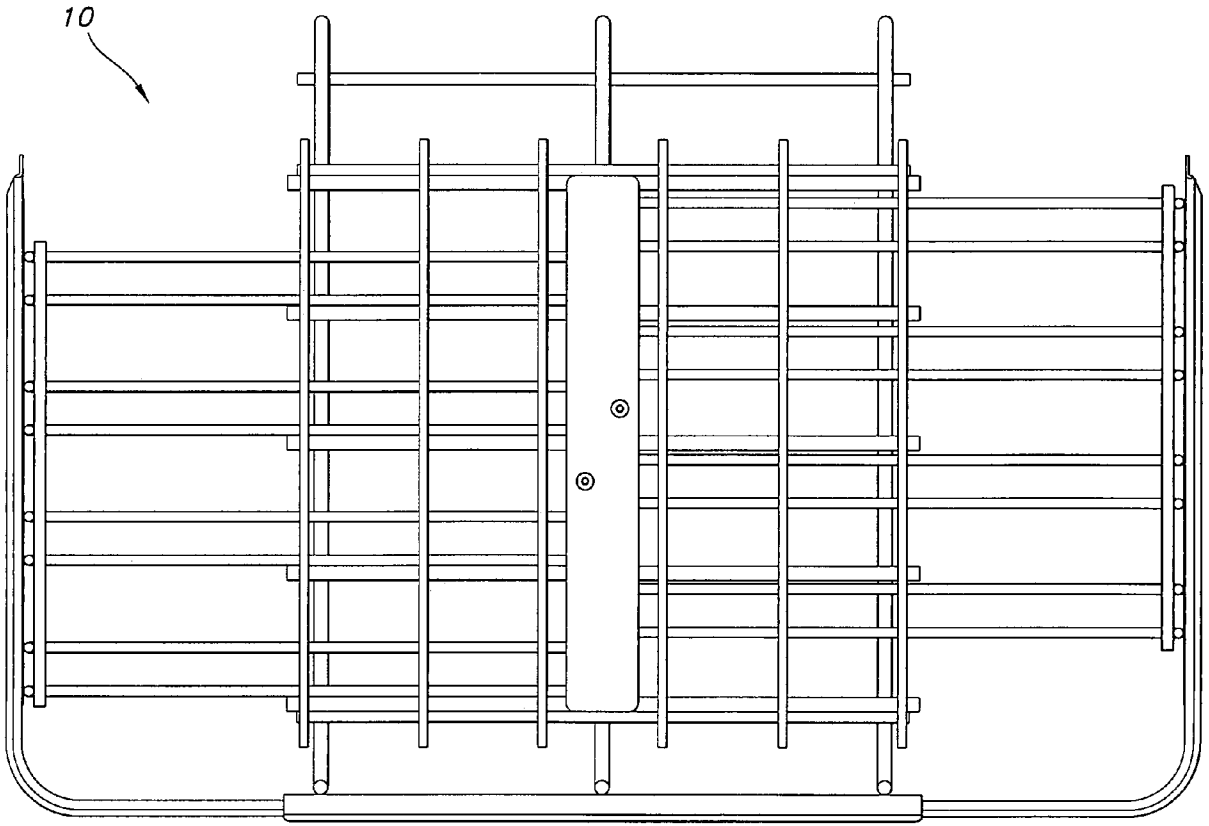
FIG. 8 shows a top view of the adjustable shelving unit of FIG. 7.

In the embodiments shown in FIGS. 1–10, the width of the adjustable shelf assembly 10 may be adjusted by sliding the first extension shelf unit 38 and/or the second extension shelf unit 64 relative to the central shelf unit 14. Extending either the first or second extension shelf units 38 or 64 relative to the central shelf unit 14 increases the width of the adjustable shelf assembly 10. Retracting either the first or second extension shelf units 38 or 64 relative to the central shelf unit 14 decreases the width of the adjustable shelf assembly 10. FIGS. 1–6 and 9 show an adjustable shelf assembly 10 in a fully retracted orientation. FIGS. 7 and 8 show an adjustable shelf assembly 10 in a fully extended orientation.

Adjustable shelf assembly 10 may be created in any desired dimensions. In certain embodiments, adjustable shelf assembly 10 is fully adjustable between widths of 9 and 14 inches. Such a size is preferred for countertop product displays proximate to a point of sale or proximate to various dispensers including coffee or soda machines. However, adjustable shelf assembly 10 may have larger dimensions. Larger dimensioned shelves may be desired for large product displays or for accompanying large items such as coolers. Larger dimensioned shelves may also be desirable in other types of retail establishments.

In other embodiments of the present invention, an adjustable shelf assembly may include an extension shelf unit slidably oriented with respect to a central shelf unit such that the depth of the adjustable shelf assembly may be increased or decreased by extending or retracting the extension shelf unit with respect to the central shelf unit. Such extension shelf unit permitting depth adjustment may be formed and may function in a similar manner to extension shelf units 38 and 64 depicted in FIG. 1. In still other embodiments, an adjustable shelf assembly may include extension shelf units for adjusting width as well as extension shelf units for adjusting depth.

As shown in FIG. 1, when first and second extension shelf units 38 and 64 are in a retracted orientation, interlocking members 50 and 76 of the first and second extension shelf units 38 and 64 interlock with one another. Interlocking members 50 and 76 are formed from portions of the support surfaces of first and second extension shelf units 40 and 66. Interlocking members 50 and 76 may be formed from any suitable material into any suitable shape. As shown in FIG. 1, interlocking members 50 and 76 are formed into fingers from bent wire. The interlocking members 50 and 76 are staggered relative to each other such that portions of the first and second extension shelf units 38 and 64 may interlock with one another when in a retracted orientation. As shown in FIG. 1, extension and retraction of first and second extension shelf units 38 and 64 are guided by the sliding interaction of interlocking members 50 and 76. Additionally, extension and retraction may be guided by the sliding interaction of interlocking members 50 and 76 with guide rails 82.

Figure 3:
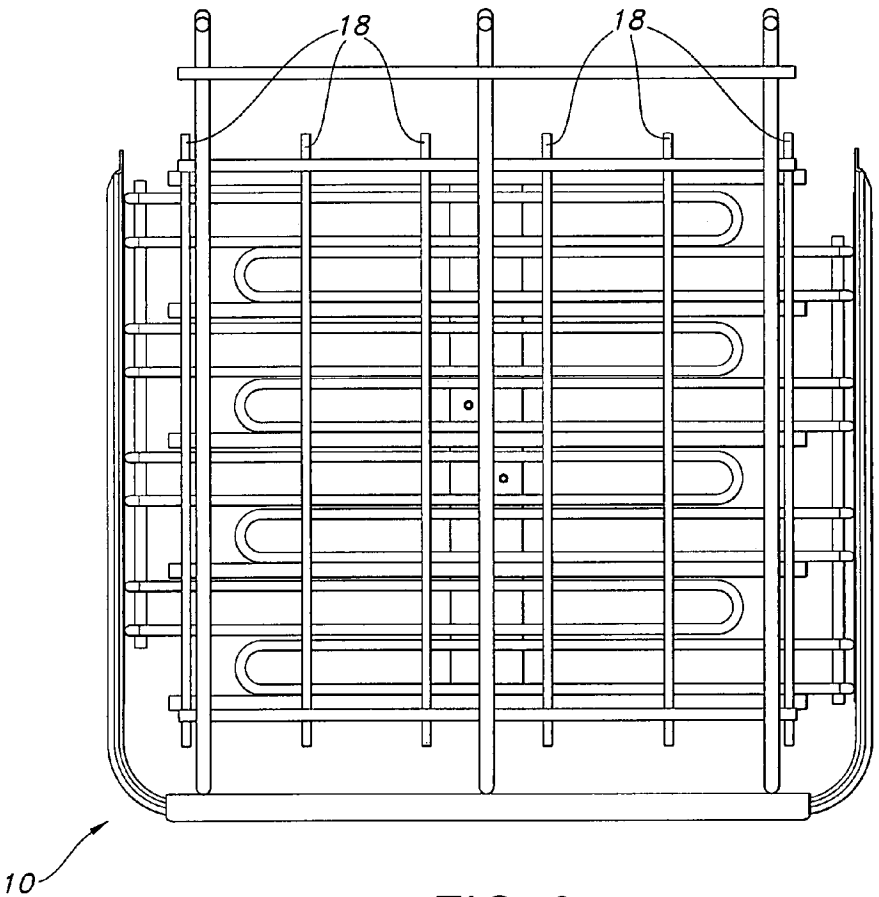
FIG. 3 shows a bottom view of the adjustable shelving unit of FIG. 1.
Figure 4:
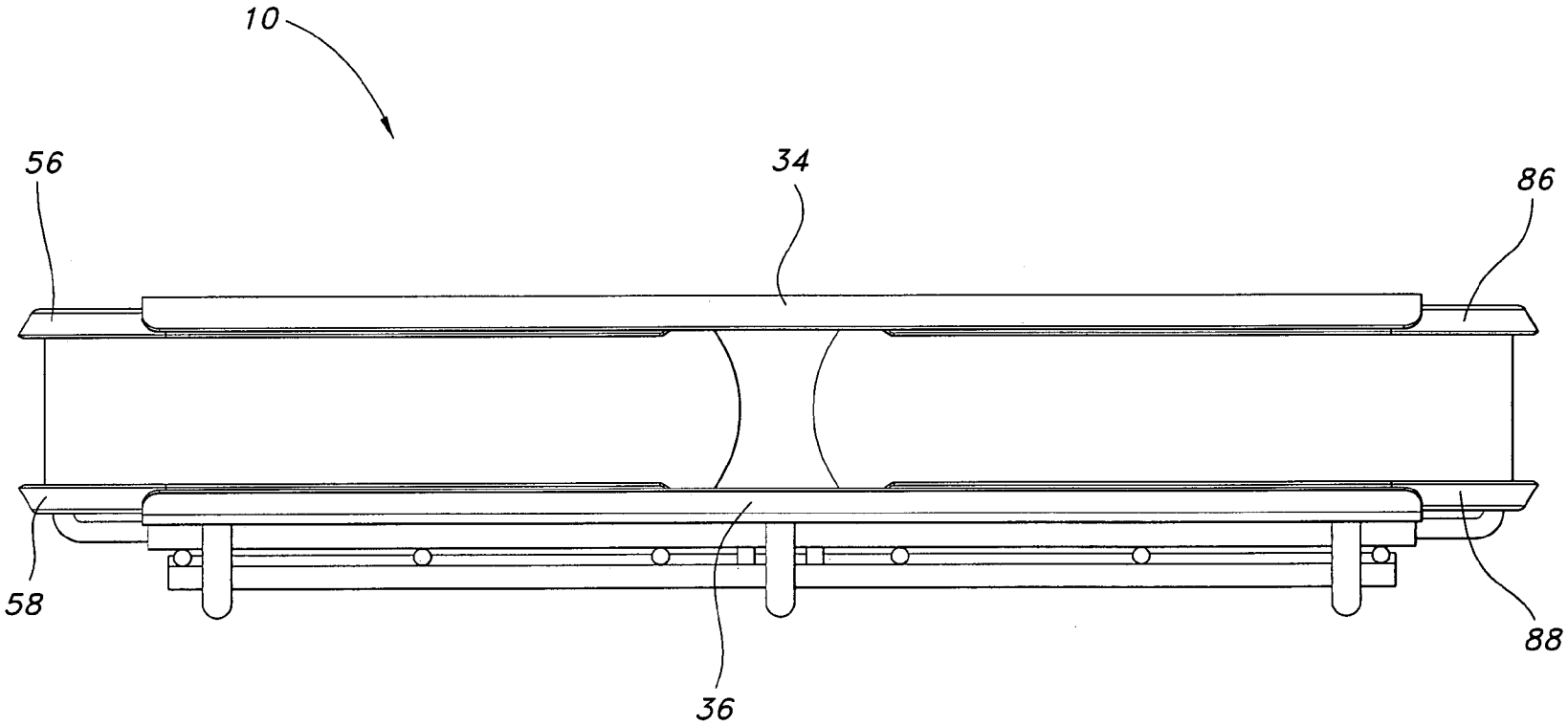
FIG. 4 shows a front view of the adjustable shelving unit of FIG. 1.
Figure 5:
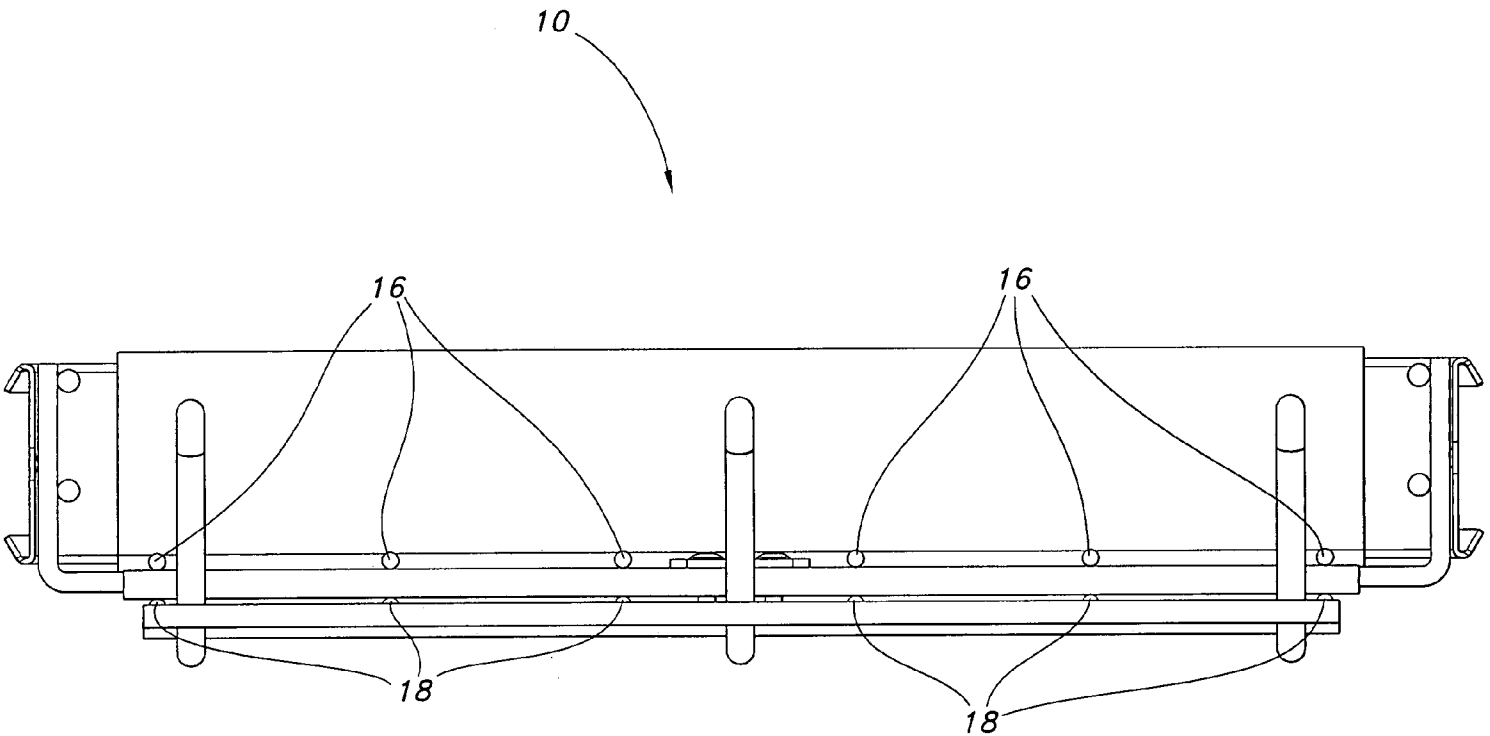
FIG. 5 shows a rear view of the adjustable shelving unit of FIG. 1.
Figure 6:
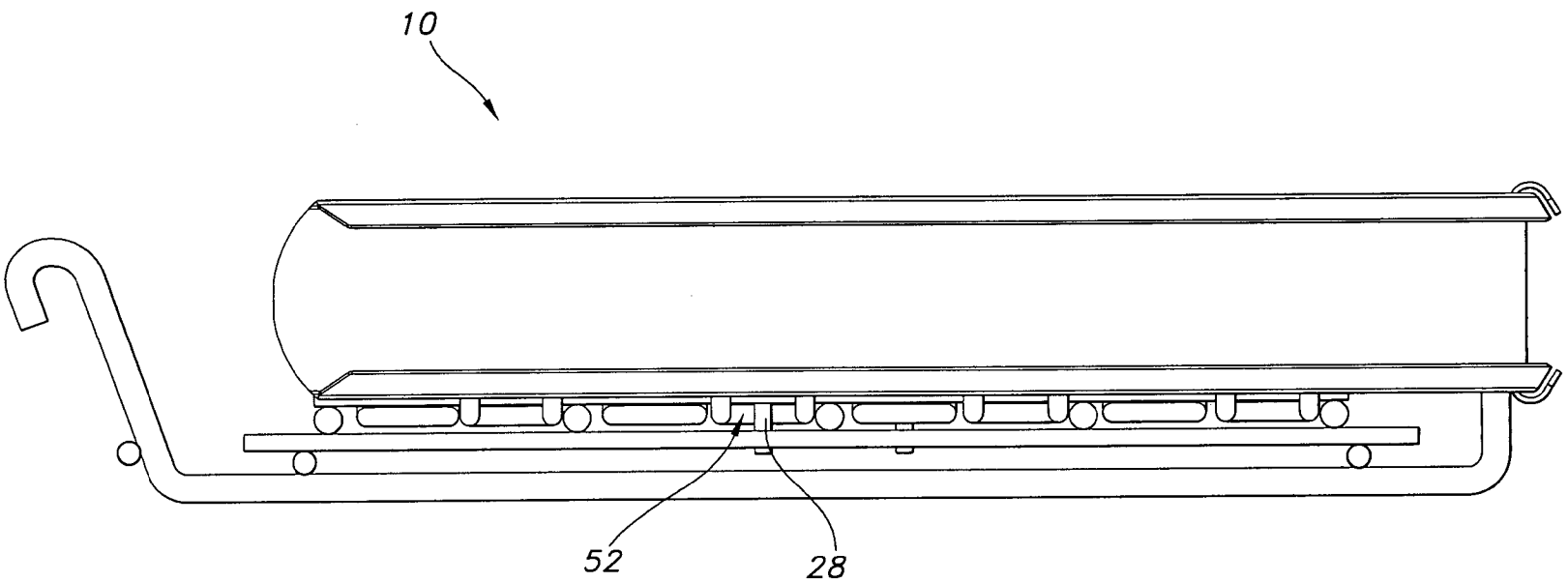
FIG. 6 shows a side view of the adjustable shelving unit of FIG. 1.

As shown in FIG. 3, central shelf unit 14 may include stops 28 downwardly extending from a portion of the top surface 16. Stops 28 are oriented to interact with interior tip portions of first and second extension shelf units 52 and 78 when first and second extension shelf units 38 and 64 are fully extended. Interior tip portions of first and second extension shelf units 52 and 78 are located proximate to the proximate sides of first and second extension shelf units 90 and 92 respectively. Stops 28 may be formed from any suitable material into any suitable shape. As shown in FIG. 3, stops 28 may be metal rivets. In other embodiments, stops 28 are not necessary, rather other portions of an adjustable shelf assembly may prevent further extension once an extension shelf unit is fully extended.

Figure 10:
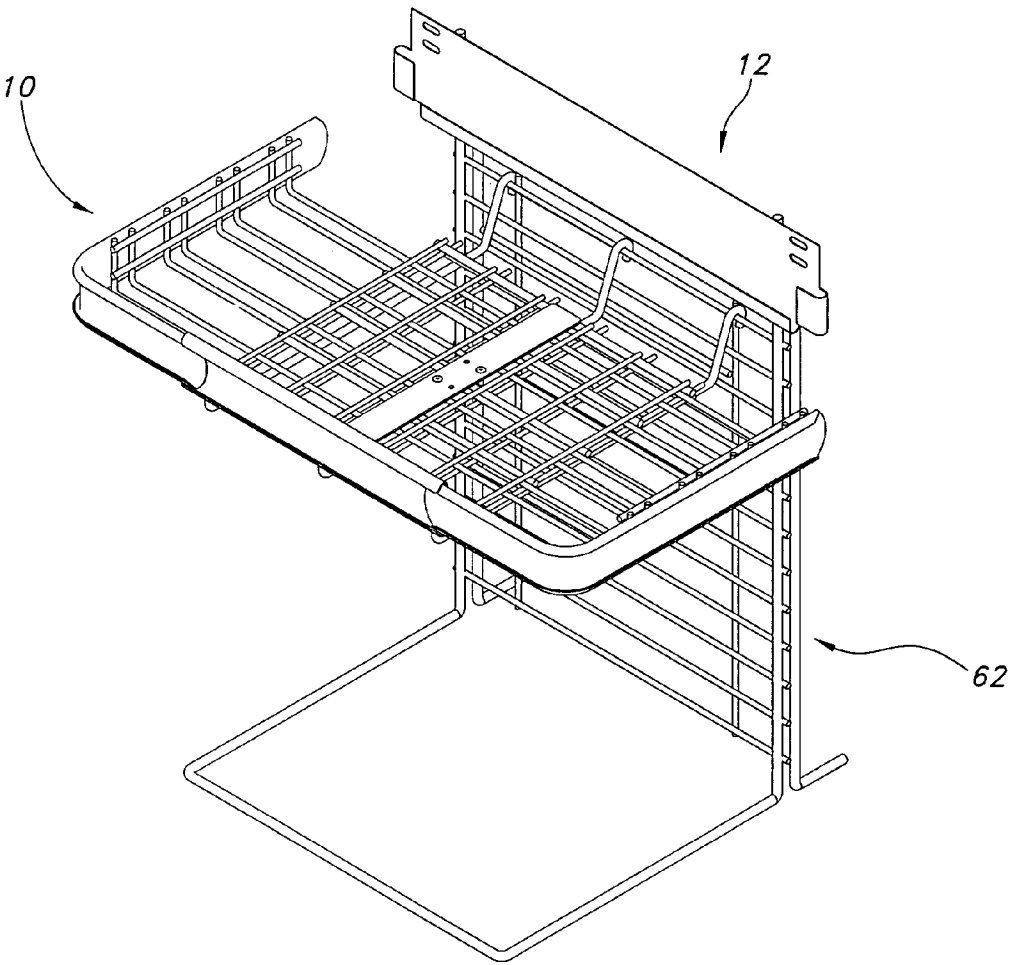
FIG. 10 shows a adjustable shelving unit according to certain embodiments of the present invention in perspective view.

As shown in FIG. 1, the central shelf unit includes attachment members 60. Attachment members 60 may be of any suitable shape and formed from any suitable material. In the embodiment shown in FIG. 1, attachment members 60 are hooks formed from bent wire extending from the central shelf unit rear edge 22. As shown in FIG. 10, attachment members 60 permit adjustable shelf assembly to be secured to a support structure 62. Support structure 62 may be any suitable structure capable of supporting adjustable shelf assembly 10, such as a wire rack, a power wing, a peg board, a wall mounted bracket or any other appropriate structure. As shown in FIG. 10, support structure 62 may be a rack formed from bent wire. Although only one adjustable shelf assembly 10 is depicted in FIG. 10, it should be readily understood that multiple adjustable shelf assemblies 10 may be secured to a single support structure 62.

Figure 9:
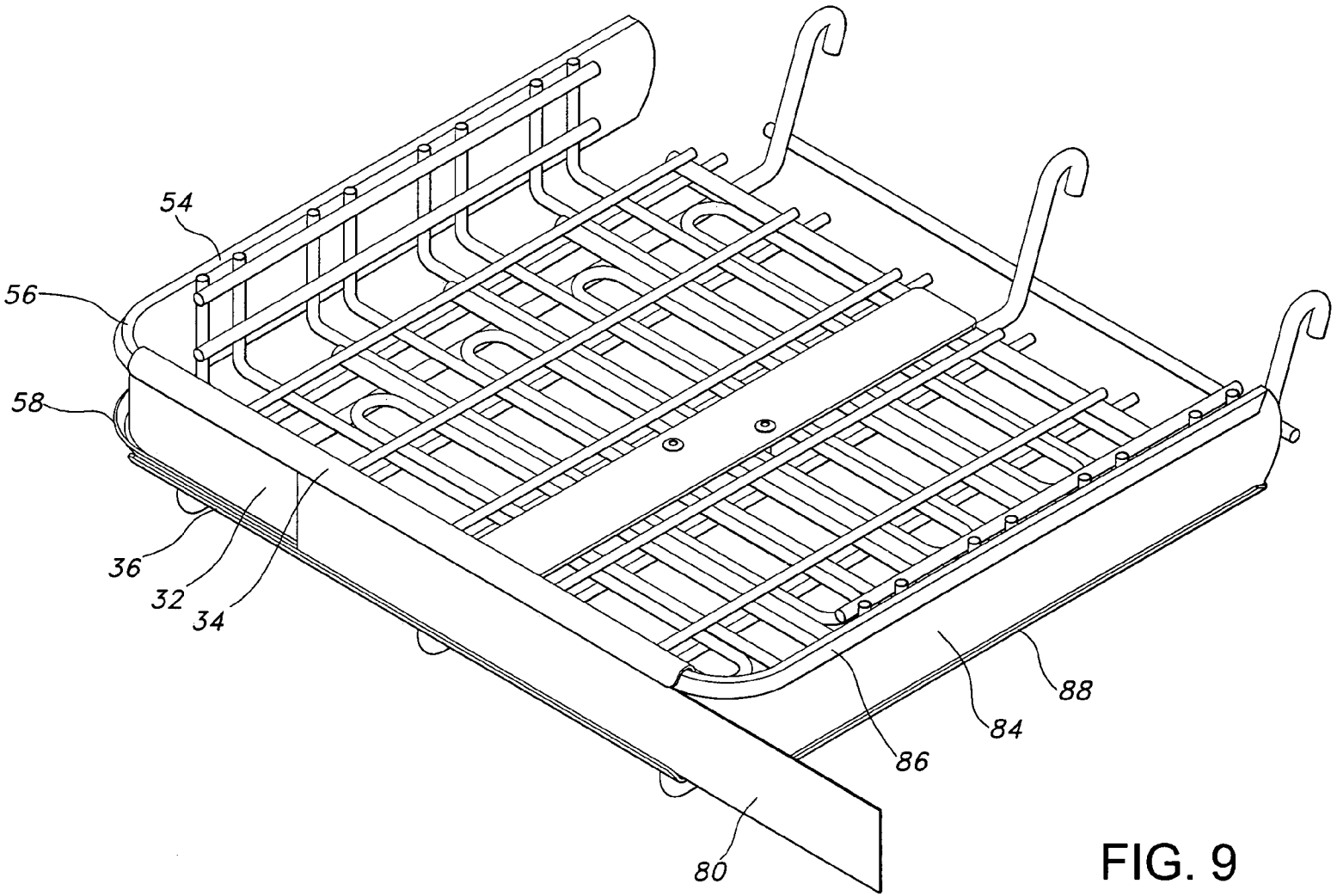
FIG. 9 shows an adjustable shelving unit in a retracted orientation according to certain embodiments of the present invention in perspective view.

As shown in FIG. 9, the adjustable shelf assembly 10 may include structure for receiving a flexible member 80, such as a product identifier, price listing, advertisement or any other desired matter. As shown in FIG. 9, a front member 32 on central shelf unit 14 includes an upper lip 34 and a lower lip 36. Upper and lower lips 34 and 36 are formed into channels suitable for slidably receiving an appropriately sized flexible member 80. In the embodiment shown in FIG. 9, adjustable shelf assembly 10 also includes first and second side members 54 and 84 secured to first and second extension shelf units 38 and 64 respectively. FIG. 9 shows first and second side members 54 and 84, which are preferably L-shaped and secured to the front and distal side edges of first and second extension shelf units 42, 48, 68 and 74 respectively. First and second side members 54 and 84 are coupled in a sliding manner to front member 32 such that extension and retraction of first and second extension shelf units 38 and 64 is not substantially inhibited. First and second side members 54 and 84 include upper and lower lips 56, 58, 86 and 88 respectively such that the same, or different, flexible members 80 may be inserted into the channels formed by the lips 56, 58, 86 and 88.

Figure 11:
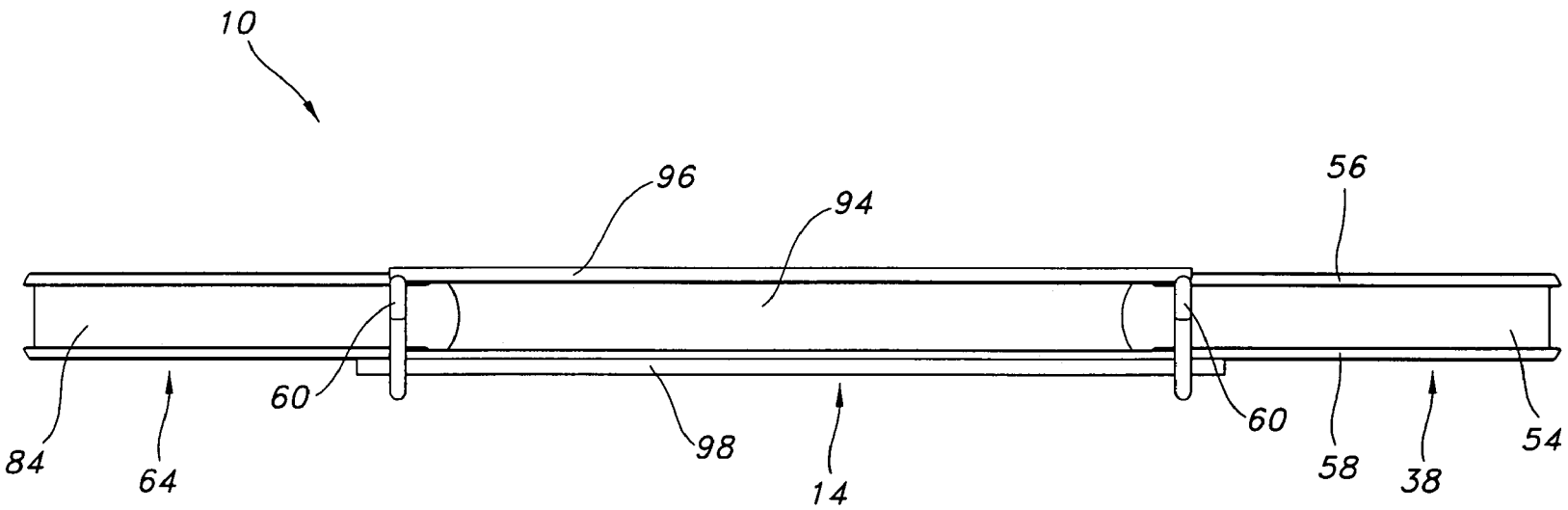
FIG. 11 shows a rear view of an adjustable shelving unit in an extended orientation according to certain embodiments of the present invention.
Figure 12:
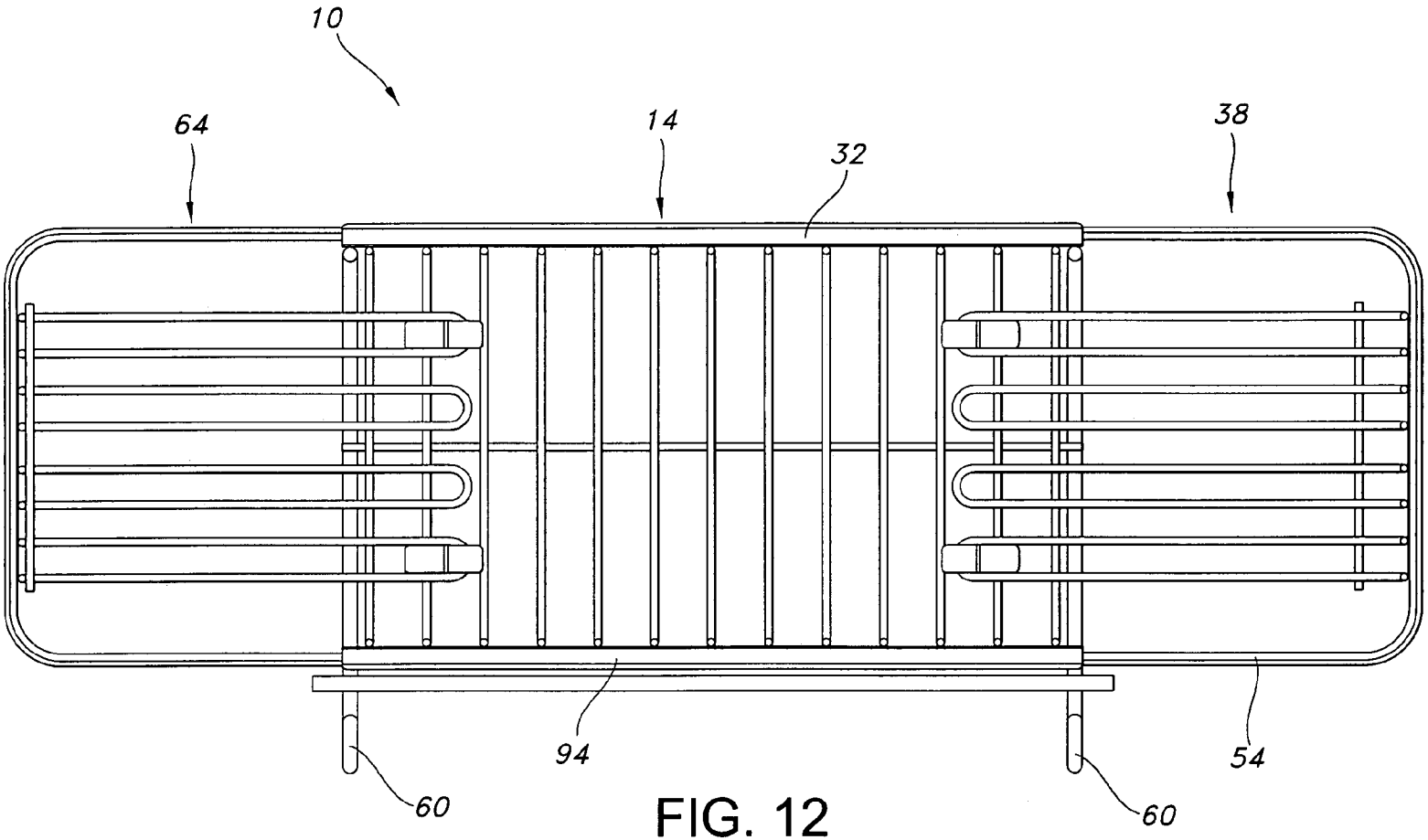
FIG. 12 shows a top view of the adjustable shelving unit of FIG. 11.
Figure 13:
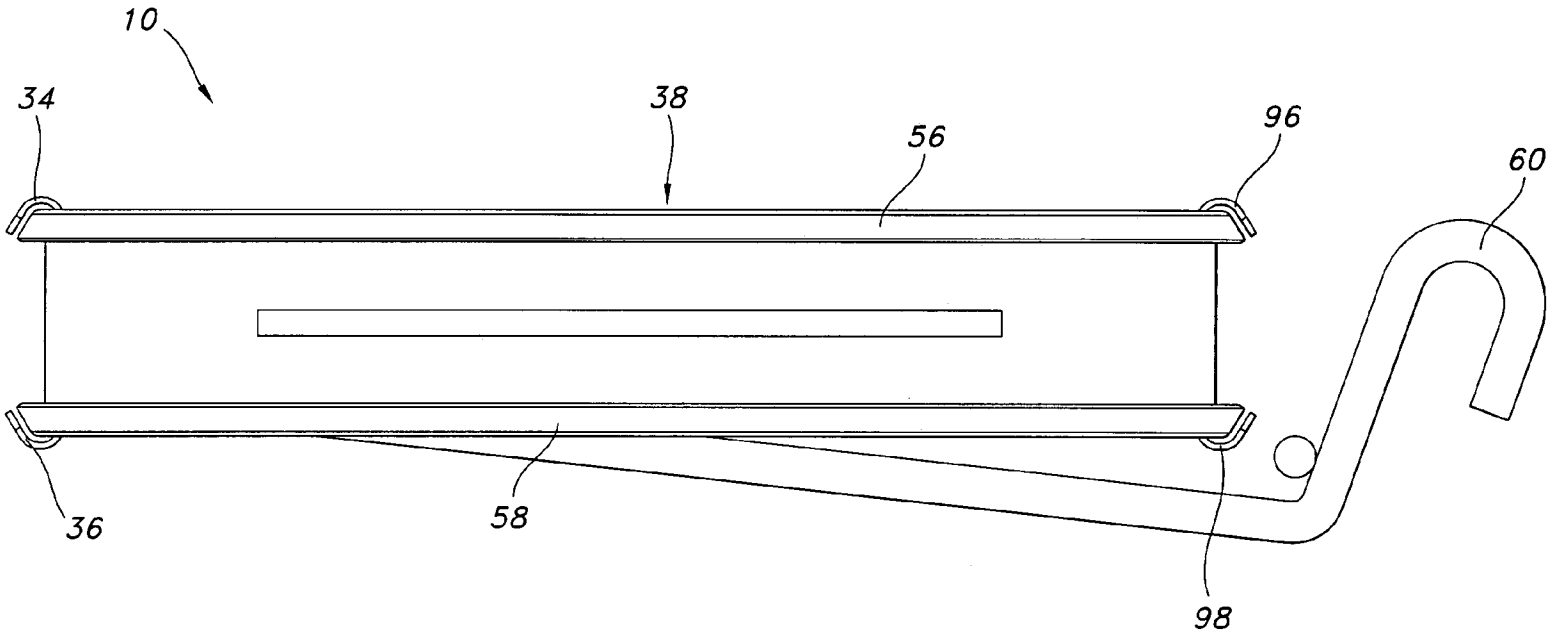
FIG. 13 shows a side view of the adjustable shelving unit of FIG. 12.

As shown in FIGS. 11–13, the adjustable shelf assembly 10 may comprise a rear member 94 in addition to front member 32. Rear member 94 may be formed and shaped similarly to front member 32, and may interact with first and second side members 54 and 84 in a similar fashion as first and second side members 54 and 84 interact with front member 32. The rear member 94 may receive the same, or a different, flexible member as front member 32. The rear member 94 on central shelf unit 14 includes an upper lip 96 and a lower lip 98. The upper and lower lips 96 and 98 are formed into channels suitable for slidably receiving an appropriately sized flexible member 80. In some of the embodiments that include the rear member 94, the side members 54 and 84 are preferably C-shaped, rather than L-shaped. The first and second side members 54 and 84 are slidably coupled to rear member 32 such that extension and retraction of first and second extension shelf units 38 and 64 is not substantially inhibited.

Figure 14:
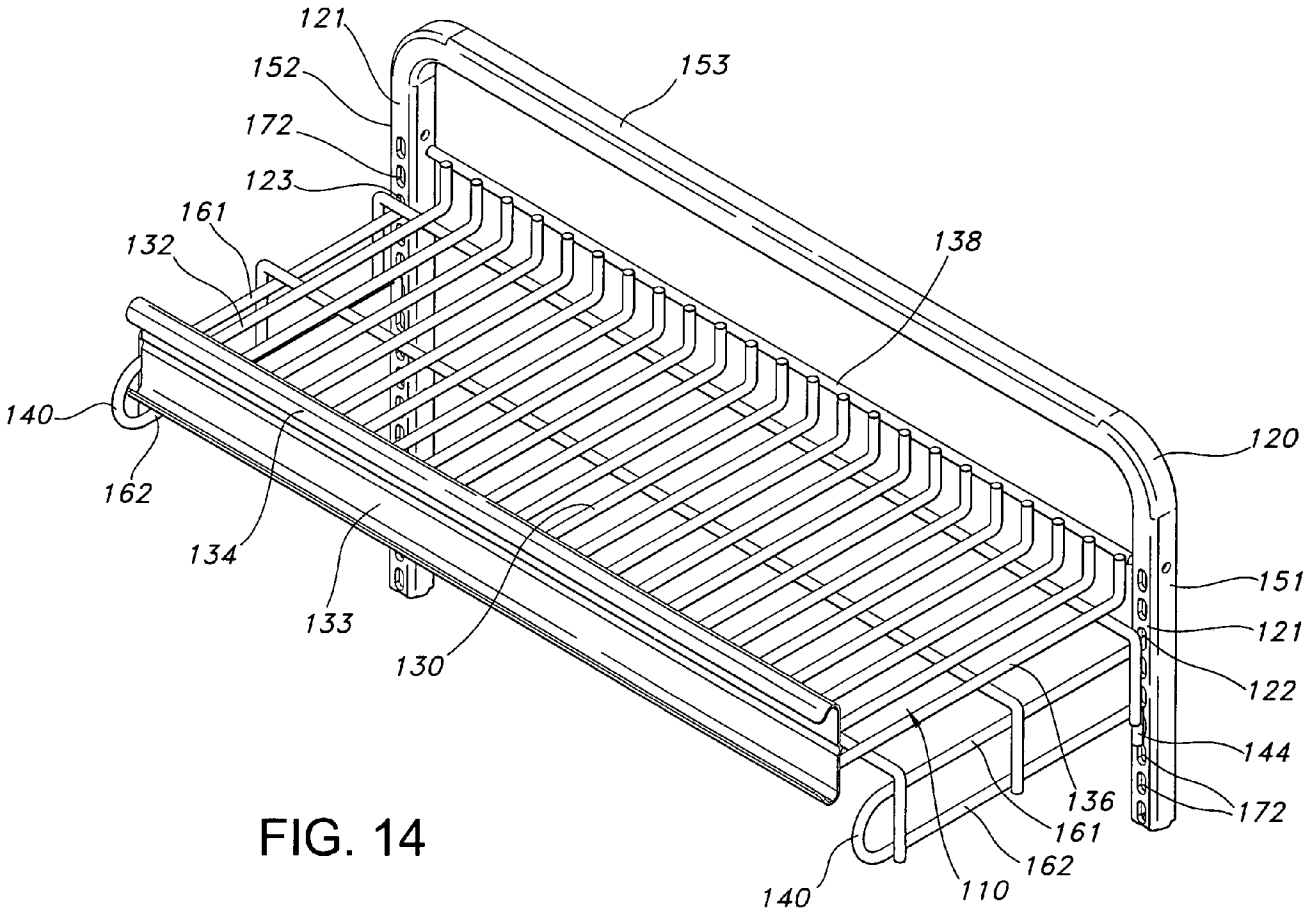
FIG. 14 shows a perspective view of an adjustable shelving unit according to another embodiment of the present invention.
Figure 15:
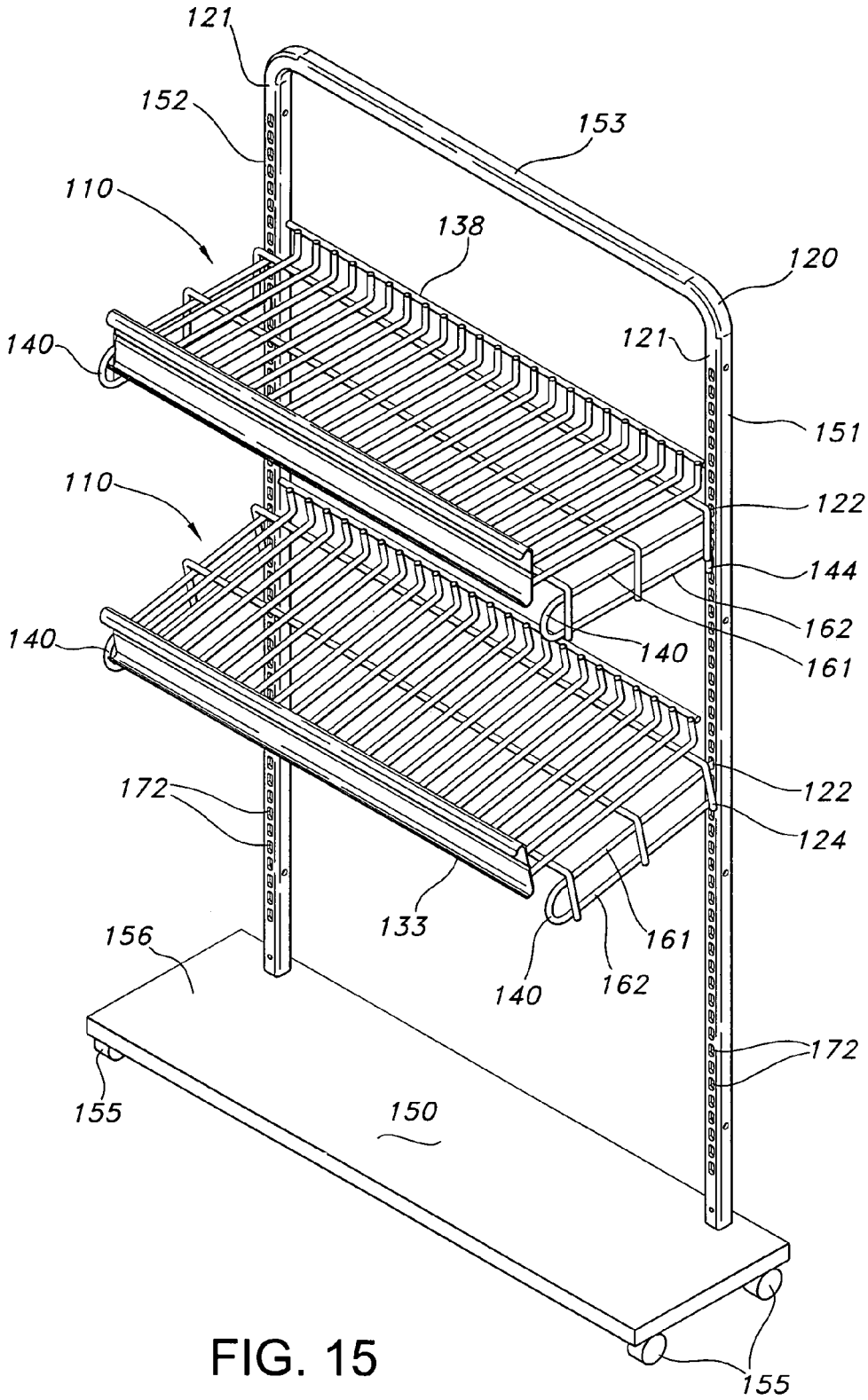
FIG. 15 shows a perspective view of an adjustable shelving unit and support frame according to another embodiment of the present invention.

Certain embodiments of the present invention provide an adjustable cantilevered shelf 110. As shown in FIGS. 14 and 15, the adjustable cantilevered shelf 110 comprises a top surface 130. The top surface 130 is bounded by two side edges 132 and 136, a front edge 134, and a rear edge 138. The top surface 130 is intended to receive merchandise or other items for display. According to certain embodiments of the present invention, the shelf 110 is formed from lengths of parallel spaced solid cylindrical metal rods and transverse spaced solid cylindrical rods forming a grid-like arrangement. One skilled in the art would understand that the shelf may be made from other suitable material if desired.

According to certain embodiments of the present invention, the shelf 110 comprises a pair of mounting rails 140. One mounting rail 140 extends from either side of the shelf. According to the certain embodiments of the present invention, each mounting rail is formed by a single length of wire and is part of the cylindrical metal rods forming the shelf. The single wire design allows for efficient and simple manufacturing of the mounting rail and a minimum number of adjustable parts. Each mounting rail 140 comprises a top rail 161 and a bottom rail 162. An upper mounting pin 142 and a lower mounting pin 144 extend from the rear portion of the top rail and bottom rail respectively. The upper mounting pin 142 and lower mounting pin 144 preferably extend downwardly from the rear edge of the mounting rail, thereby forming a single bend. The single bend is preferably substantially a right angle according to certain embodiments of the present invention. The top rail is preferably slightly longer than the bottom rail causing the upper mounting pin and lower mounting pin to be slightly offset from one another. That is, the upper mounting pin is positioned slightly more rearwardly than the lower mounting pin. This allows the shelf to be adjustable as will be described further.

According to certain embodiments of the present invention, the front edge 134 of the shelf 110 is bent upwards at substantially a right angle. Products placed on the shelf may rest against the front edge of the shelf, particularly when the shelf is oriented at an angle. The front edge 134 is therefore configured to provide support to displayed items when the shelf is in a forward sloping position. According to certain embodiments, the front edge 134 comprises an elongated frame 133. The elongated frame 133 preferably extends the length of the front edge 134 of the shelf. The elongated frame is preferably configured to receive advertising or other indicia along the front edge 134 of the shelf 110.

Certain aspects of the present invention comprise a support frame 120. The support frame is preferably generally U-shaped according to certain embodiments of the present invention. The support frame comprises a base surface 150 having an upper surface 156 and a bottom surface (not shown). Wheels 155 may preferably be attached to the bottom surface of the base to facilitate movement of the support frame according to certain embodiments of the present invention.

The display frame, according to certain embodiments of the present invention, comprises two vertical members 151, 152 extending upward from each side of the base 150. The two vertical members are connected by a horizontal member 153 that extends between the top of each vertical member. Each vertical member comprises a front receiving surface 121. The front receiving surface 121 of the vertical members contain a plurality of receiving openings 172. The openings are preferably evenly spaced along the front receiving surface.

The shelf 110 may be attached to the support frame 120 and placed in the retail establishment to display product for sale. To secure the shelf to the display frame, each upper mounting pin 142 of the mounting rail 140 is placed inside first openings 122, 123 in the front receiving surface 121 of the display frame. The first openings are each located on one of the vertical members and are at the same vertical location. The placement of the lower mounting pin 144 with respect to the front receiving surface 121 determines the orientation of the shelf 110. If a horizontal, substantially flat orientation of the shelf 110 is desired, the lower mounting pin 144 is placed flush against the front receiving surface 121 of the receiving structure 120. The lower mounting pin therefore simply rests against the front receiving surface 121. Due to the offset of the upper mounting pins and the lower mounting pins, the lower mounting pin can rest against the front receiving surface and resist downward forces acting on the shelf when product is placed on the shelf. It should be understood that the amount of offset of the upper mounting pin and the lower mounting pin is preferably approximately equal to the thickness of the front receiving surface.

Figure 16:
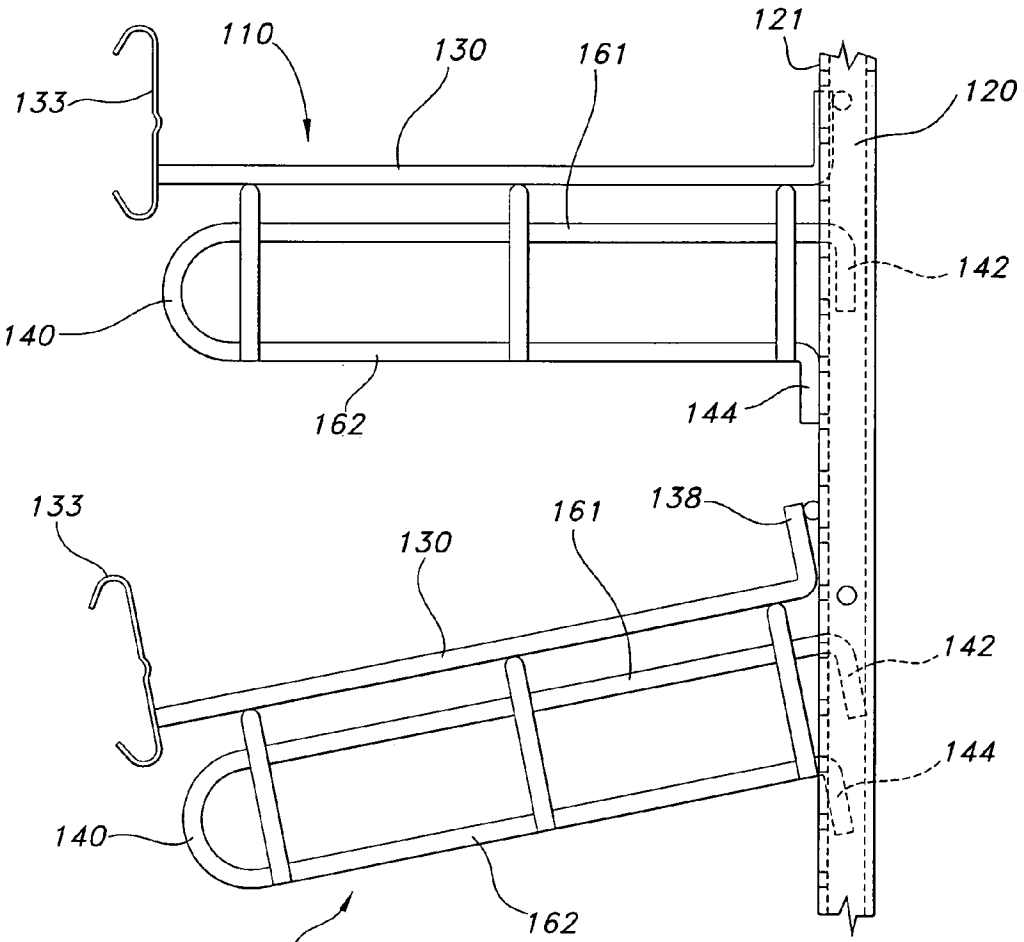
FIG. 16 is a schematic view showing adjustable shelving units in horizontal and forward sloping orientations according to certain embodiments of the present invention.

If it is desired to orient the shelf at a forward sloping angle, each of the lower mounting pins are placed into second openings 124, 125 in the front receiving surface 121, located below the first opening as shown in FIG. 16. The second openings are located at the same vertical location on each vertical member of the display frame.

According to certain embodiments of the present invention, the openings in the front receiving surface 121 are equally spaced along the front receiving surface such that any two receiving openings may be utilized as the first and second openings 122, 123, 124 and 125. It should also be understood that the shelf may be attached to a standard peg board and used in the same manner as described above to achieve various orientations.

The manufacturer may adjust the degree of the forward slope of the shelf by adjusting the relative position of the lower mounting pin 144 with respect to the upper mounting pin 142. Because the upper and lower mounting pins 142 and 144 are each formed by a single bend in respective ends of a single length of wire that comprises the mounting rail 140, the relative positioning of the upper mounting pin 142 and lower mounting pin 144 may be easily adjusted without additional tooling and significant changes in the manufacturing process.

Figure 17:
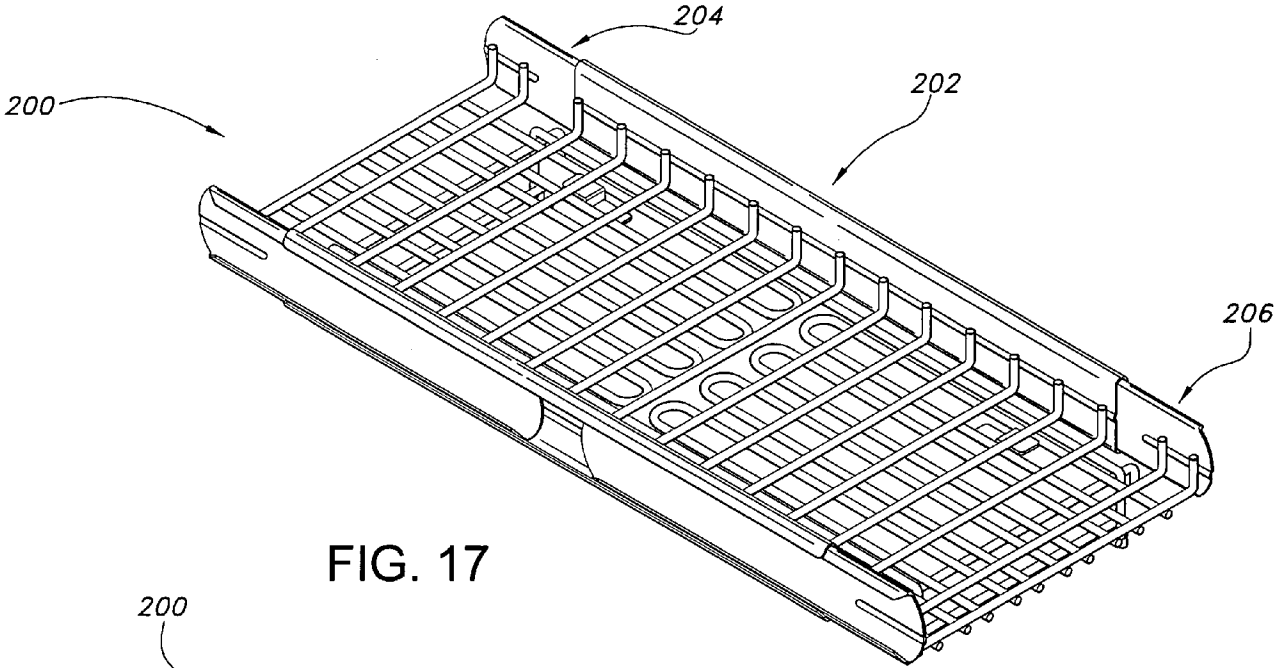
FIG. 17 is a perspective view of a adjustable shelving unit according to another embodiment of the present invention.

FIG. 17 shows an embodiment of an adjustable shelving unit that combines an adjustable width or depth feature and an adjustable forward sloping or horizontal feature. The adjustable shelving unit 200 shown in FIG. 17 may include a central shelf unit 202, a first extension shelf unit 204 and a second extension shelf unit 206. The first and second shelf units 204, 206 may be oriented in a sliding manner with respect to the central shelf unit 202 such that a user may increase the width of the unit 200 by extending and decrease the width of the unit 200 by retracting the first or second shelf units 204, 206 with respect to the central shelf unit 202. The central shelf unit 202, first extension shelf unit 204 and second extension shelf unit 206 may be formed, assembled and used in a similar manner to the central shelf unit, first extension shelf unit and second extension shelf unit shown in FIG. 1 and described above.

Figure 18:
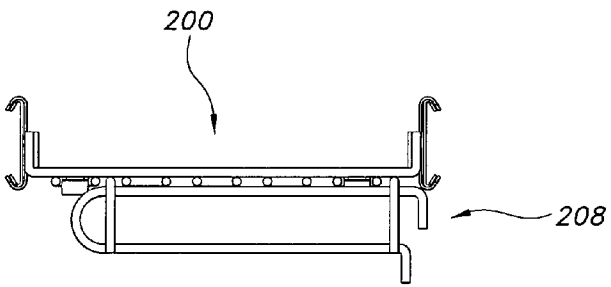
FIG. 18 is a side view of the adjustable shelving unit shown in FIG. 17.
Figure 19:
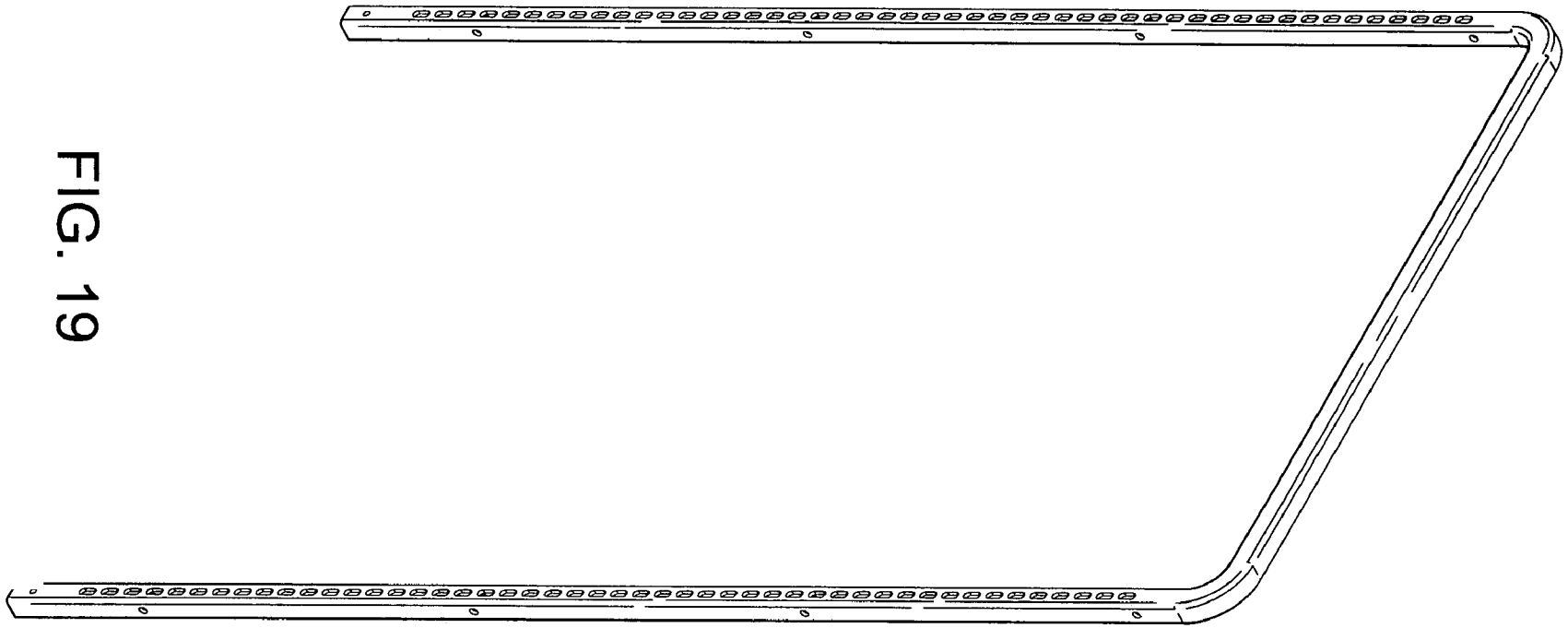
FIG. 19 is a perspective view of a support useable with the adjustable shelving unit shown in FIG. 17 according to certain embodiments of the present invention.

In the embodiment shown in FIGS. 17 and 18, attachment members 208 extend from the central shelf unit 202 and permit the adjustable shelving unit 200 to be secured to a suitable support, such as the support shown in FIG. 19, in alternatively a horizontal position or a forward sloping position. The attachment members 208 may be formed of similar materials and function similarly to the attachment members shown in FIG. 16 and described above.

Changes and modifications, additions and deletions may be made to the structures recited above and shown in the drawings without departing from the scope or spirit of the invention.

The invention claimed is:

1. An adjustable shelving unit, comprising:

(a) a generally planar shelf, comprising:

(i) at least two attachment members extending from the shelf, the attachment members each comprising a top mounting rail and a bottom mounting rail; and (ii) an upper mounting pin extending downwardly from the rear edge of the top mounting rail and a lower mounting pin extending downwardly from the rear edge of each bottom mounting rail, the upper and lower mounting pins being offset, wherein the and the top and bottom mounting rails and the upper and lower mounting pins comprise a one-piece wire structure; and (b) a support frame comprising two vertical members, the vertical members each comprising a plurality of openings formed in a front receiving surface, at least some of the openings being substantially evenly spaced apart from one another;

whereby the shelf is mountable to the support frame by inserting the upper mounting pins in first openings of the receiving surface and the lower mounting pins are selectively able to be positioned against the front receiving surface of the vertical member causing the shelf to be oriented in a substantially horizontal orientation or inside second openings on the front receiving surface of the vertical member causing the shelf to be oriented in a substantially forward sloping orientation, and wherein the shelf is adapted to have its width or depth increased by extending or decreased by retracting one portion of the shelf with respect to another portion of the shelf.

2. The adjustable shelving unit of claim 1, wherein the relative positioning of the lower pin with respect to the upper pin determines the angle of forward slope of the shelf.

3. The adjustable shelving unit of claim 1, wherein each of the upper mounting pin and the lower mounting pin comprises a single bend.

4. The adjustable shelving unit of claim 1, wherein the front edge of the shelf bends upward at approximately a right angle and provides support for displayed items when the shelf is in the forward sloping orientation.

5. The adjustable shelving unit of claim 1, wherein the front edge of the shelf comprises a frame for receiving indicia.

6. The adjustable shelving unit of claim 1, wherein the top rail is longer than the bottom rail.

7. A shelving unit, comprising:

(a) a generally planar shelf, comprising:

(i) at least two attachment members extending from the shelf, the attachment members each comprising a top mounting rail and a bottom mounting rail; and (ii) an upper mounting pin extending downwardly from the rear edge of the top mounting rail and a lower mounting pin extending downwardly from the rear edge of each bottom mounting rail, the upper and lower mounting pins being offset;

wherein the and the top and bottom mounting rails and the upper and lower mounting pins comprise a one-piece wire structure; and (b) a support frame comprising two vertical members, the vertical members each comprising a plurality of openings formed in a front receiving surface, at least some of the openings being substantially evenly spaced apart from one another;

whereby the shelf is mountable to the support frame by inserting the upper mounting pins in first openings of the receiving surface and the lower mounting pins are selectively able to be positioned against the front receiving surface of the vertical member causing the shelf to be oriented in a substantially horizontal orientation or inside second openings on the front receiving surface of the vertical member causing the shelf to be oriented in a substantially forward sloping orientation.

8. The shelving unit of claim 7, wherein the relative positioning of the lower pin with respect to the upper pin determines the angle of forward slope of the shelf.

9. The shelving unit of claim 7, wherein each of the upper mounting pin and the lower mounting pin comprises a single bend.

10. The shelving unit of claim 7, wherein the front edge of the shelf bends upward at approximately a right angle and provides support for displayed items when the shelf is in the forward sloping orientation.

11. The shelving unit of claim 7, wherein the front edge of the shelf comprises a frame for receiving indicia.

12. The shelving unit of claim 7, wherein the top rail is longer than the bottom rail.

* * * * *